US011373594B2

(12) United States Patent
Ohara

(10) Patent No.: US 11,373,594 B2
(45) Date of Patent: Jun. 28, 2022

(54) DISPLAY APPARATUS

(71) Applicant: JOLED INC., Tokyo (JP)

(72) Inventor: Masanori Ohara, Tokyo (JP)

(73) Assignee: JOLED INC., Tokyo (JP)

( * ) Notice: Subject to any disclaimer, the term of this patent is extended or adjusted under 35 U.S.C. 154(b) by 0 days.

(21) Appl. No.: 17/232,915

(22) Filed: Apr. 16, 2021

(65) Prior Publication Data

US 2021/0335243 A1 Oct. 28, 2021

(30) Foreign Application Priority Data

Apr. 24, 2020 (JP) ..... JP2020-077751

(51) Int. Cl.
*G09G 3/3233* (2016.01)
*G09G 3/3266* (2016.01)
*G09G 3/3283* (2016.01)

(52) U.S. Cl.
CPC ..... *G09G 3/3233* (2013.01); *G09G 3/3266* (2013.01); *G09G 3/3283* (2013.01); *G09G 2300/0426* (2013.01); *G09G 2300/0439* (2013.01); *G09G 2300/0809* (2013.01); *G09G 2320/0626* (2013.01)

(58) Field of Classification Search
None
See application file for complete search history.

(56) References Cited

U.S. PATENT DOCUMENTS 10,818,230 B1 * 10/2020 Lu ..... G09G 3/3233
2009/0015744 A1 * 1/2009 Sekine ..... G09G 3/3659 349/39
2012/0188150 A1 * 7/2012 Shirouzu ..... G09G 3/3233 345/76
2012/0268446 A1 * 10/2012 Yamauchi ..... G09G 3/3618 345/212
2013/0033479 A1 * 2/2013 Zebedee ..... G09G 3/3648 345/212
2016/0210898 A1 7/2016 Tsuge et al.

FOREIGN PATENT DOCUMENTS

JP 2011-145622 7/2011
JP 2013-057947 3/2013
WO 2015/033496 3/2015

* cited by examiner

*Primary Examiner* — Nitin Patel
*Assistant Examiner* — Amen W Bogale
(74) *Attorney, Agent, or Firm* — Greenblum & Bernstein, P.L.C.

(57) ABSTRACT

A display apparatus includes pixels two-dimensionally arranged. Each of the pixels includes a light-emitting element, a capacitor which retains a voltage of a data signal, a drive transistor which feeds a current according to the voltage of the data signal to the light-emitting element, a first write transistor connected between a data signal line and a gate electrode of the drive transistor, a second write transistor connected between the first write transistor and a gate electrode of the drive transistor, and a counter transistor including a source electrode and a drain electrode, one of the source electrode and the drain electrode being connected between the first write transistor and the second write transistor. The other of the source electrode and the drain electrode of the counter transistor is connected to a counter voltage line which feeds a counter voltage.

6 Claims, 14 Drawing Sheets

FIG. 6

One example of gradation voltage

| | Black | White |
|---|---|---|
| Gradation voltage (V) | 0 | 10 |

FIG. 7

One example of counter voltage

| | Counter voltage VCNT (V) |
|---|---|
| First killer pattern display (FIG. 2A) | 0 |
| Second killer pattern display (FIG. 2C) | 10 |

FIG. 9

Results of comparison

| | Display apparatus according to conventional example | Display apparatus 100 |
|---|---|---|
| SIG voltage Va (V) | 10 | 10 |
| Counter voltage VCNT (V) | None | 0 |
| Gate node Vg (V) | 0 (equivalent to black SIG voltage) | 0 (equivalent to black SIG voltage) |
| Vds (V) of write transistor | 10 (=Va-Vg) | 0 (=Vb-Vg) |
| Leak amount of write transistor | Large | Small |

FIG. 11

One example of gradation voltage

| | Black | Intermediate | White |
|---|---|---|---|
| Gradation voltage (V) | 0 | 5 | 10 |

FIG. 12

| | Natural image | Black-tone image | White-tone image |
|---|---|---|---|
| Counter voltage VCNT (V) | 5 (intermediate where white = 10 V and black = 0 V) | 2.5 (black: 0 V + 5/2 V) | 7.5 (white: 10 V - 5/2 V) |
| Characteristics | Ioff of bright pixel and Ioff of dark pixel can be suppressed in balanced manner | Ioff of black pixel can be significantly suppressed (effective in movies) | Ioff of white pixel can be significantly suppressed (effective in images having small difference in gradation within display area) |

DISPLAY APPARATUS

CROSS REFERENCE TO RELATED APPLICATION

The present application is based on and claims priority of Japanese Patent Application No. 2020-077751 filed on Apr. 24, 2020. The entire disclosure of the above-identified application, including the specification, drawings and claims is incorporated herein by reference in its entirety.

FIELD

The present disclosure relates to a display apparatus.

BACKGROUND

Organic electroluminescent (EL) elements are known as electro-optical elements used in self-emitting display apparatuses. The organic EL element is an electro-optical element utilizing a phenomenon that an organic thin film emits light under application of an electric field. In the organic EL element, color gradation is obtained by controlling the value of the current flowing in the organic EL element. For this reason, pixels of the organic EL display apparatus including the organic EL element each include a pixel circuit including a drive transistor for controlling the current amount of the organic EL element and a capacitor which retains the control voltage of the drive transistor.

The drive transistor affects the luminance of light emitted from the organic EL element due to a variation in properties of the drive transistor, and reduces the display quality in some cases. Examples of the variation in properties of the drive transistor include a variation in threshold voltage and a variation in mobility. Thus, PTL 1 discloses a display apparatus which performs threshold voltage correction to correct the variation in threshold voltage of the drive transistor and mobility correction to correct the variation in mobility of the drive transistor.

CITATION LIST

Patent Literature

PTL 1: Japanese Unexamined Patent Application Publication No. 2013-057947

SUMMARY

Technical Problem

However, the display quality in the display apparatus disclosed in PTL 1 may be reduced in some cases, for example, when predetermined display is performed.

Thus, the present disclosure has been made in consideration of such a problem, and an object of the present disclosure is to provide a display apparatus having improved display quality.

Solution to Problem

To achieve the object above, the display apparatus according to one aspect of the present disclosure is a display apparatus including pixels two-dimensionally arranged. Each of the pixels includes a light-emitting element; a capacitance element which retains a first voltage fed through a signal line; a drive transistor which feeds a current according to the first voltage to the light-emitting element; a first write transistor which includes a source electrode and a drain electrode and is connected between the signal line and a gate electrode of the drive transistor, one of the source electrode and the drain electrode being connected to the signal line; a second write transistor connected between (i) an other of the source electrode and the drain electrode of the first write transistor and (ii) the gate electrode of the drive transistor; and a counter transistor including a source electrode and a drain electrode, one of the source electrode and the drain electrode being connected between (iii) the other of the source electrode and the drain electrode of the first write transistor and (iv) one of a source electrode and a drain electrode of the second write transistor, an other of the source electrode and the drain electrode of the counter transistor being connected to a voltage line which feeds a second voltage.

Advantageous Effects

The display apparatus according to one aspect of the present disclosure can have improved display quality.

BRIEF DESCRIPTION OF DRAWINGS

These and other advantages and features will become apparent from the following description thereof taken in conjunction with the accompanying Drawings, by way of non-limiting examples of embodiments disclosed herein.

FIG. 6 is a diagram illustrating one example of the gradation voltage according to the embodiment.

FIG. 7 is a diagram illustrating one example of the counter voltage according to the embodiment.

FIG. 9 is a diagram illustrating the results of comparison in the leak amount between the display apparatus according to the embodiment and the according to a conventional example.

FIG. 11 is a diagram illustrating another example of the gradation voltage according to the embodiment.

FIG. 12 is a diagram illustrating another example of the counter voltage according to the embodiment.

DESCRIPTION OF EMBODIMENT (How the Present Disclosure is Achieved)

The underlying knowledge forming the basis of the present disclosure will be described before description of embodiments according to the present disclosure.

Figure 1:
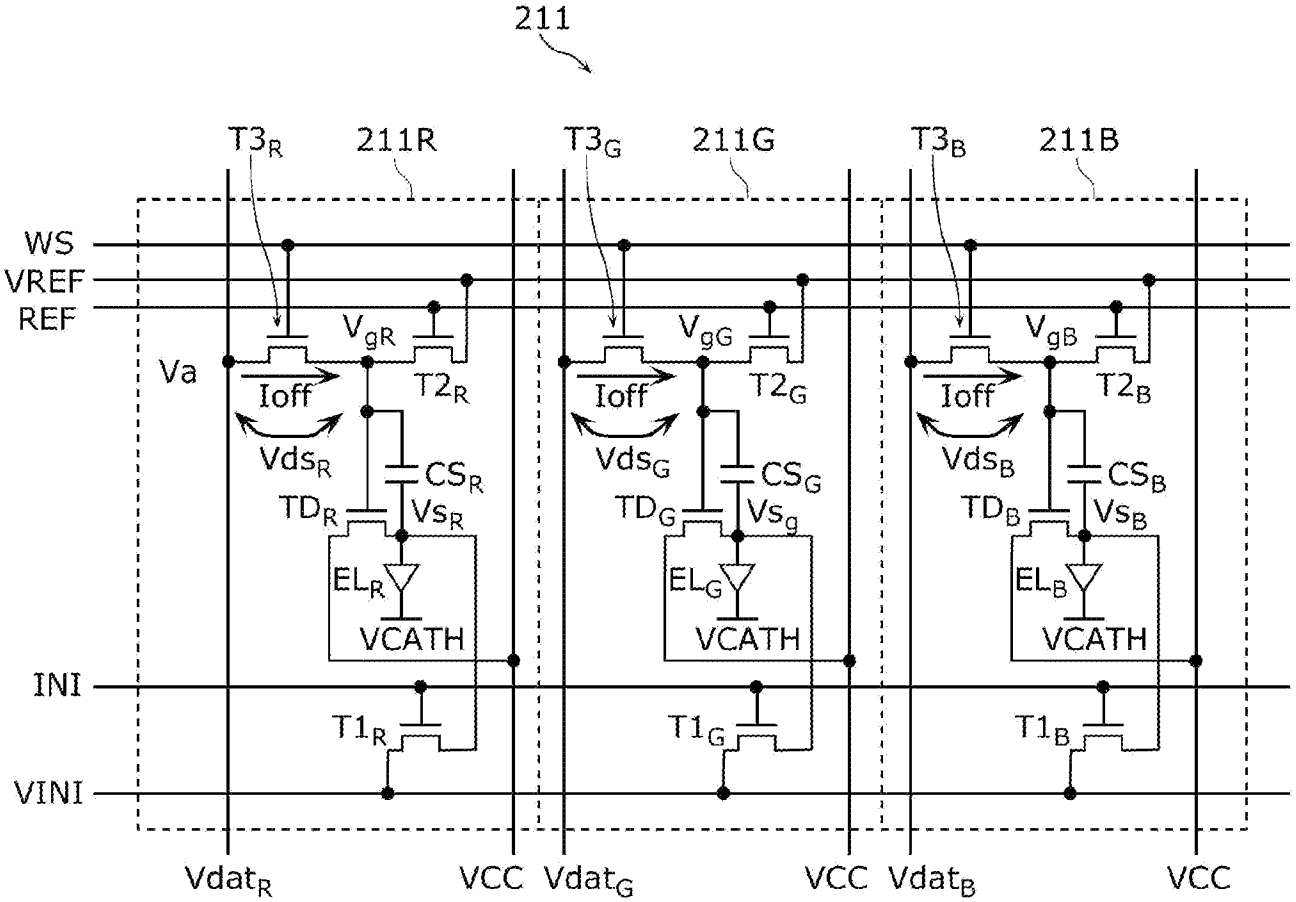
FIG. 1 is a circuit diagram illustrating one example of the configuration of a pixel circuit according to a conventional example.

Initially, the circuit configuration of an organic EL display apparatus according to a conventional example will be described with reference to FIG. 1. FIG. 1 is a circuit diagram illustrating one example of the configuration of pixel circuit 211 according to a conventional example. Pixels of the display apparatus each include pixel circuit 211.

As illustrated in FIG. 1, subpixel circuits 211R, 211G, and 211B included in pixel circuit 211 have identical configurations. Hereinafter, the configuration of pixel circuit 211 will be described with reference to subpixel circuit 211R.

Subpixel circuit 211R includes initialization transistor $T1_R$, compensation transistor $T2_R$, write transistor $T3_R$, capacitor $CS_R$ (one example of a capacitance element), drive transistor $TD_R$, light-emitting element $EL_R$. Subpixel circuit 211R also includes control signal lines INI, REF, and WS, reference voltage lines VINI and VREF, data signal line $Vdat_R$, positive power supply line VCC, and negative power supply line VCATH.

Initialization transistor $T1_R$ is turned on according to control signal INI to set the source node of drive transistor $TD_R$ to reference voltage VINI.

Compensation transistor $T2_R$ is turned on according to control signal REF to set the gate node of drive transistor $TD_R$ to reference voltage Vref.

Write transistor $T3_R$ is turned on according to control signal WS to retain the voltage of data signal $Vdat_R$ in capacitor $CS_R$. For example, write transistor $T3_R$ is a single gate transistor. The voltage retained in capacitor $CS_R$ is also referred to as retained voltage.

Drive transistor $TD_R$ feeds a current to light-emitting element $EL_R$ according to the voltage retained in capacitor $CS_R$. Thereby, light-emitting element $EL_R$ emits light a luminance represented by data signal $Vdat_R$.

Subpixel circuits 211G and 211B also have the same configuration as that of subpixel circuit 211R.

For this reason, in subpixel circuits 211R, 211G, and 211B, data signals $Vdat_R$, $Vdat_G$, and $Vdat_B$ are retained at the same timing according to the same control signals INI, REF, and WS, and light-emitting elements $EL_R$, $EL_G$, and $EL_B$ emit light beams at the luminance according to the retained data signals.

Figure 2A:
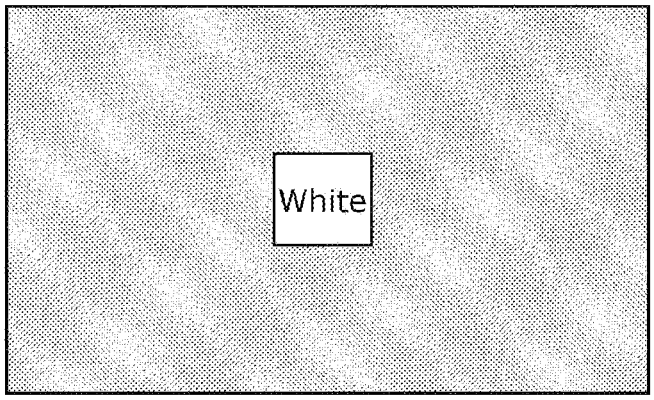
FIG. 2A is a diagram showing a first display pattern for describing the problem.
Figure 2B:
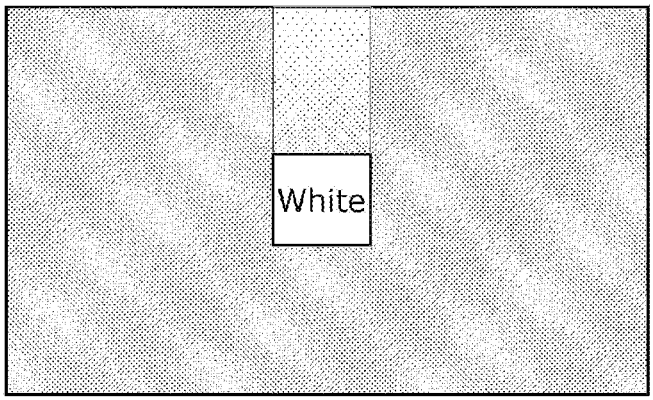
FIG. 2B is a diagram illustrating an image in which the first display pattern is displayed.
Figure 2C:
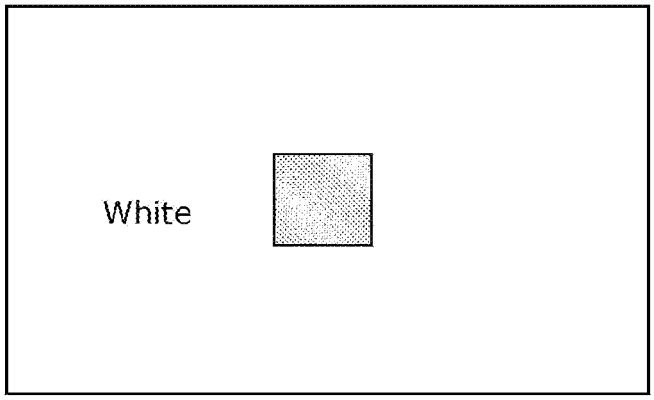
FIG. 2C is a diagram showing a second display pattern for describing the problem.

The problem of the display apparatus including pixel circuit 211 described above will be described with reference to FIGS. 2A to 2C. FIG. 2A is a diagram showing a first display pattern for describing the problem. FIG. 2B is a diagram illustrating an image in which the first display pattern is displayed. FIG. 2B illustrates one frame of image. In FIG. 2B, the density of black is represented by the dot density. A higher dot density indicates that darker display is performed. FIG. 2C is a diagram illustrating showing a second display pattern for describing the problem. In FIG. 2B, writing is sequentially performed from the upper side to the lower side of the image.

As illustrated in FIG. 2B, when the display apparatus according to the conventional example displays the display pattern illustrated in FIG. 2A in which a white window is displayed in the central portion of the display panel with a black background, so-called black level degradation occurs, which is a phenomenon that the pixels which are located above the white window and perform black display (hereinafter, also referred to as black pixels) are brighter than the surrounding black pixels. Within one frame, writing to the black pixels having the black level degradation is performed before writing to the pixels which display the white window (hereinafter, also referred to as white pixels). For example, the black level degradation does not occur in the black pixels subjected to writing after writing to the pixels displaying the white window within one frame, i.e., the black pixels below the white window.

This is because the retained voltages of the black pixels subjected to writing before writing to the white pixels are changed (increased in FIG. 2B) after writing to the white pixels. The black pixels and the white pixels arranged in the same pixel column are subjected to writing (data writing) of the voltage of data signal $Vdat_R$ through data signal line $Vdat_R$ disposed for the black pixels and the white pixels arranged in the same pixel column. When data writing is performed on the white pixel, capacitor $CS_R$ of the black pixel subjected to writing before writing to the white pixel is electrically separated from data signal line $Vdat_R$ by the write transistor of the black pixel (such as write transistor $T3_R$). In other words, the retained voltage is electrically separated from the voltage of data signal $Vdat_R$. Hereinafter, the voltage of data signal $Vdat_R$ is also referred to as gradation voltage.

However, when the source drain voltage of write transistor $T3_R$ of the black pixel is higher than or equal to a predetermined voltage during data writing to the white pixel, off leakage occurs in write transistor $T3_R$. This changes (here, increases) the retained voltages of the black pixels, generating the black level degradation.

The black gradation data according to the black display (gradation voltage in black display) is written to the black pixels located above the white window. When the writing of the black gradation data is completed, the voltage of the black gradation data is retained in capacitor $CS_R$. In other words, the potential of the gate node of drive transistor $TD_R$ (gate potential $Vg_R$) corresponds to the voltage of the black gradation data.

In this state, the white pixels located below the black pixels are subjected to writing. When writing to the white pixel is performed, the voltage of the white gradation data is fed to data signal line $Vdat_R$. The voltage of the white gradation data is higher than the voltage of the black gradation data.

When the voltage of the white gradation data is fed to data signal line $Vdat_R$, drive transistor $TD_R$ of the black pixel is off, and electrically separates data signal line $Vdat_R$, to which the voltage of the white gradation data is fed, from the voltage of the black gradation data retained in capacitor $CS_R$ of the black pixel.

However, when the two voltages have a large potential difference, that is, when source drain voltage $Vds_R$ of write transistor $T3_R$ is large, off leakage current Ioff flows through the write transistor $T3_R$ according to source drain voltage $Vds_R$. Source drain voltage $Vds_R$ is a voltage corresponding to the difference between retained voltage (gate potential $Vg_R$) and SIG voltage Va. This flow of off leakage current Ioff increases the retained voltage of the black pixel undergoing writing within one frame. As a result, display brighter than the original black display is performed to cause the black level degradation. An increase in retained voltage means an increase in gate potential $Vg_R$.

As illustrated in FIG. 2C, when the display apparatus according to the conventional example displays a black window in the central portion of the display panel with a white background, so-called white level reduction occurs, which is a phenomenon that the white pixels located above the black window are darker than the surrounding white pixels. Within one frame, writing to the white pixels having the white level reduction is performed before writing to the black pixels which display the black window. For example, the white level reduction does not occur in the white pixels subjected to writing after writing to the pixels which display the black window within one frame, i.e., the white pixels located below the black window.

This is because the retained voltage of the white pixels subjected to writing before writing to the black pixels is changed (reduced in FIG. 2C) after writing to the black pixels. When data writing is performed on the black pixel, capacitor $CS_R$ of the white pixel subjected to writing before writing to the black pixel is electrically separated from data signal line $Vdat_R$ by the write transistor of the white pixel (such as write transistor $T3_R$). In other words, the retained voltage is electrically separated from the voltage of data signal $Vdat_R$.

However, when the source drain voltage of write transistor $T3_R$ of the white pixel is higher than or equal to a predetermined voltage during data writing to the black pixel, off leakage occurs in write transistor $T3_R$. This changes (here, reduces) the retained voltage of the white pixel, generating the white level reduction.

Thus, the present inventors have conducted extensive research on a display apparatus enabling suppression of such a reduction in display quality, and devised the apparatus described below.

An embodiment according to the present disclosure will now be described with reference to the drawings. The embodiment described below illustrates one specific example according to the present disclosure. Accordingly, numeric values, shapes, materials, components, arrangement positions of the components, and connection forms thereof shown in the embodiment below are exemplary, and should not be construed as limitations to the present disclosure. Thus, among the components of the embodiments below, the components not described in an independent claim according to the present disclosure will be described as arbitrary components.

The drawings are schematic views, and are not always strictly drawn. In the drawings, identical reference numerals are given substantially identical configurations, and duplication of the description thereof will be omitted or simplified.

In this specification, terms representing properties of relations between elements (such as "equal"), numeric values, and ranges of numeric values indicate not only strict meanings but also substantially equivalent ranges thereof including differences of several percent, for example. Although terms such as "constant" are used, those expressions indicate substantially constant ranges including differences of several percent, for example.

Embodiment

[1. Configuration of Display Apparatus]

Figure 3:
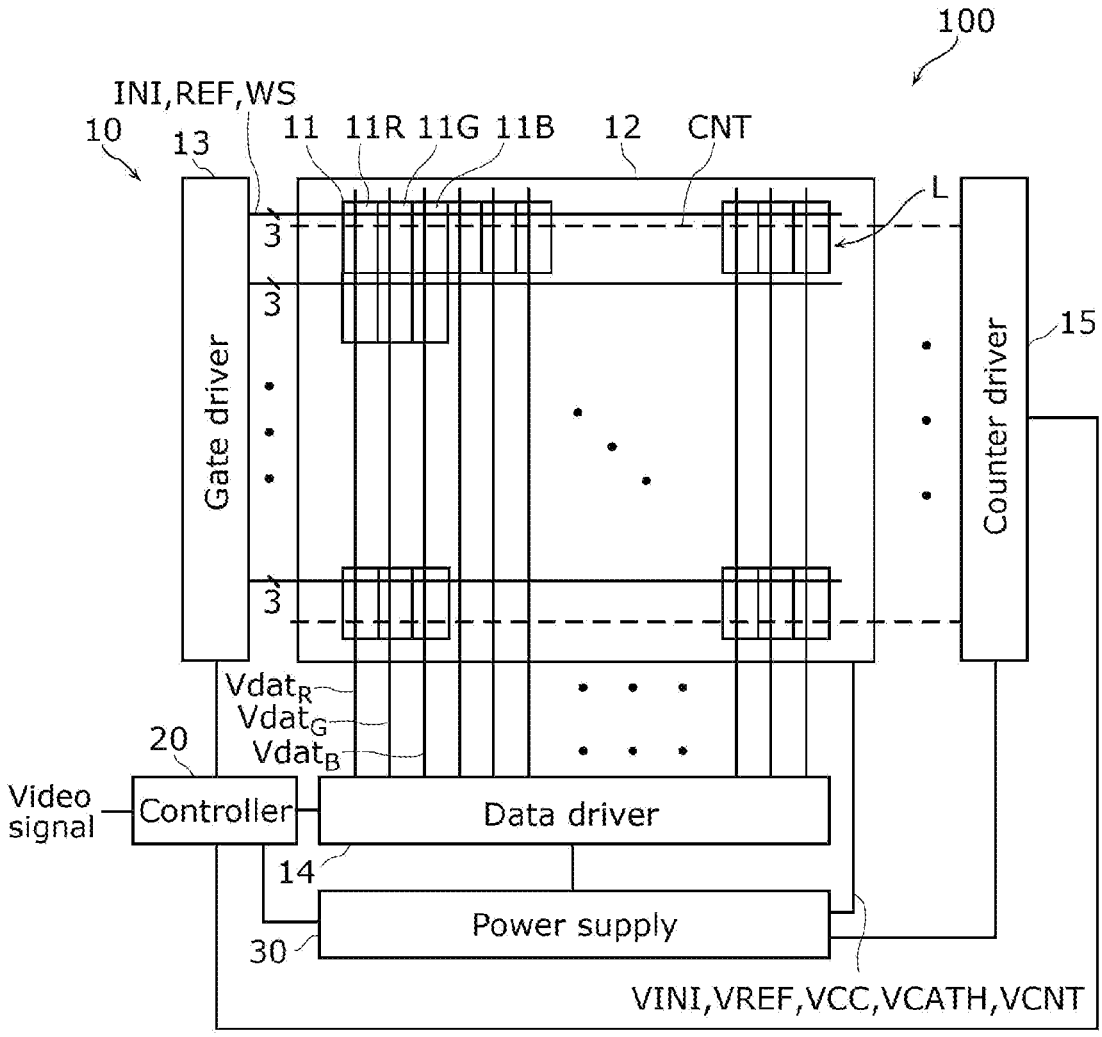
FIG. 3 is a block diagram illustrating one example of a functional configuration of the display apparatus according to an embodiment.

Initially, a schematic configuration of display apparatus 100 according to the present embodiment will be described with reference to FIGS. 3 to 5. FIG. 3 is a diagram illustrating a schematic configuration of display apparatus 100 according to the present embodiment. For simplicity, in the description below, the same reference numeral will be given to a signal and a line through which the signal is transmitted in some cases. The same reference numeral will be given to a circuit and the region in which the circuit is disposed in some cases. In FIG. 3, control signal line CNT is represented by a dashed line.

As illustrated in FIG. 3, display apparatus 100 includes display module 10, controller 20, and power supply 30. Display module 10 includes display panel 12 (display unit), gate driver 13, data driver 14, and counter driver 15.

Display panel 12 includes a plurality of pixels circuits 11 (pixels) two-dimensionally arranged (arranged in a matrix). In other words, display panel 12 includes a plurality of pixels rows L. Each pixel circuit 11 includes subpixel circuits 11R, 11G, and 11B (subpixels) corresponding to colors R, G, and B of the light beams to be emitted. Although an example in which each of pixels included in the plurality of pixel rows L includes an organic EL element as a light-emitting element is described in the present embodiment, any other light-emitting element can be used. Display panel 12 may include a quantum-dot light emitting diode (QLED) element as the light-emitting element.

Each row in the matrix includes four control signal lines INI, REF, WS, and CNT connected to a plurality of pixels circuits 11 disposed in the row. Control signal lines INI, REF, and WS transmit control signals INI, REF, and WS, which are fed from gate driver 13, to pixel circuits 11. Control signal line CNT transmits control signal CNT, which is fed from counter driver 15, to pixel circuits 11. The number of control signal lines and the number of control signals are exemplary, and any other numbers can be used. Control signal lines INI, REF, and WS are one example of a scanning line.

The scanning line is arranged for each pixel row L to select pixel row L for writing the data voltage corresponding to the video signal.

Each of columns in the matrix includes three data signal lines $Vdat_R$, $Vdat_G$, and $Vdat_B$ connected to a plurality of pixels circuits 11 disposed in the column. Data signal lines $Vdat_R$, $Vdat_G$, and $Vdat_B$ transmit data signals $Vdat_R$, $Vdat_G$, and $Vdat_B$ to pixel circuits 11, the data signals $Vdat_R$, $Vdat_G$, and $Vdat_B$ being associated with the luminances of light beams R, G, and B and being fed from data driver 14.

Although gate driver 13 and counter driver 15 are arranged in one side of display panel 12 in FIG. 3, these drivers may be arranged in both sides of display panel 12. Data driver 14 may be mounted on display panel 12 by Chip on Glass (COG) or by Chip On Film (COF).

Controller 20 controls the components in display module 10. Controller 20 receives a video signal from the outside, and feeds a control signal to gate driver 13, data driver 14, and counter driver 15 to cause display panel 12 to display each frame of image in the video signal. Controller 20 controls the voltage value of counter voltage VCNT.

Power supply 30 feeds operational power to display panel 12, gate driver 13, data driver 14, counter driver 15, and controller 20. For example, power supply 30 feeds reference voltages VINI and VREF, positive power supply voltage VCC, negative power supply voltage VCATH (hereinafter, also simply referred to as VCATH voltage), and counter voltage VCNT to display panel 12.

Here, a detailed configuration of pixel circuit 11 will be described with reference to FIGS. 4 and 5. FIG. 4 is a circuit diagram illustrating one example of the configuration of pixel circuit 11 according to the present embodiment.

Figure 4:
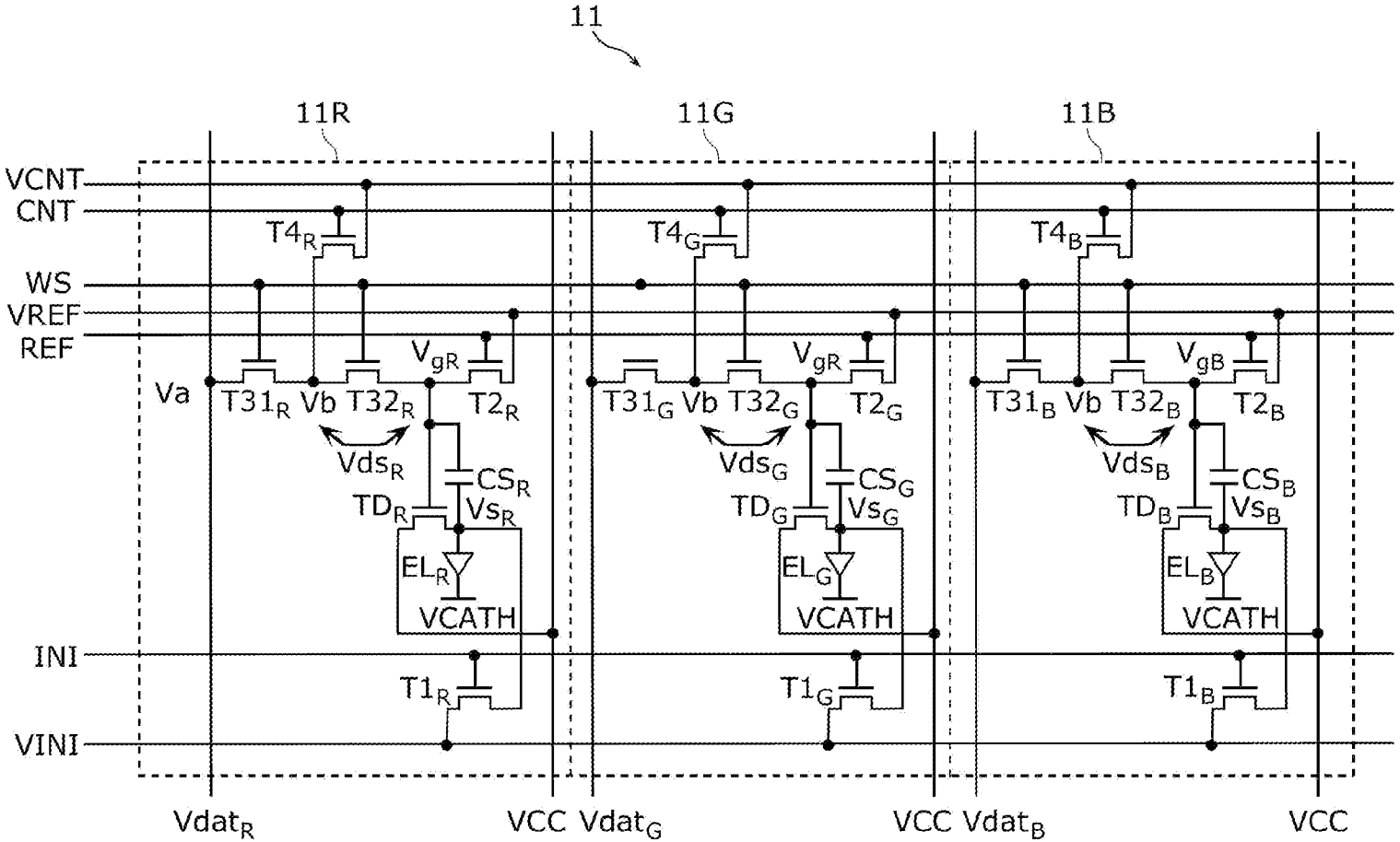
FIG. 4 is a circuit diagram illustrating one example of a configuration of the pixel circuit according to the embodiment.

As illustrated in FIG. 4, subpixel circuits 11R, 11G, and 11B included in pixel circuit 11 have identical configurations. The configuration of pixel circuit 11 will now be described with reference to subpixel circuit 11R. Subpixel circuit 11R includes first write transistor $T31_R$ and second write transistor $T32_R$, rather than write transistor $T3_R$ of subpixel circuit 211R in pixel circuit 211 according to the conventional example, and includes counter transistor $T4_R$. Pixel circuit 11 includes control signal line CNT and counter voltage line VCNT. Differences from the conventional example will be mainly described below. Identical reference numerals are given to configurations identical to those of the conventional example, and duplication of the description will be omitted or simplified.

Subpixel circuit 11R includes initialization transistor $T1_R$, compensation transistor $T2_R$, first write transistor $T31_R$, second write transistor $T32_R$, capacitor $CS_R$, drive transistor $TD_R$, and light-emitting element $EL_R$. Subpixel circuit 11R also includes control signal lines INI, REF, WS, and CNT, reference voltage lines VINI and VREF, data signal line $Vdat_R$, positive power supply line VCC, negative power supply line VCATH, and counter voltage line VCNT. Initialization transistor $T1_R$ and compensation transistor $T2_R$ are not essential components.

First write transistor $T31_R$ and second write transistor $T32_R$ are connected to the same control signal line WS, and are turned on according to control signal WS to retain the voltage of data signal $Vdat_R$ in capacitor $CS_R$. Thus, first write transistor $T31_R$ and second write transistor $T32_R$ are a double gate transistor, for example. Control signal line WS may or may not be disposed to be shared by first write transistor $T31_R$ and second write transistor $T32_R$.

First write transistor $T31_R$ is connected between data signal line $Vdat_R$ and the gate electrode of drive transistor $TD_R$. Specifically, one of the source electrode and the drain electrode of first write transistor $T31_R$ is connected to data signal line $Vdat_R$, and the other of the source electrode and the drain electrode thereof is connected to one of the source electrode and the drain electrode of second write transistor $T32_R$.

Second write transistor $T32_R$ is connected between first write transistor $T31_R$ and the gate electrode of drive transistor $TD_R$. Specifically, one of the source electrode and the drain electrode of second write transistor $T32_R$ is connected to the other of the source electrode and the drain electrode of first write transistor $T31_R$, and the other of the source electrode and the drain electrode thereof is connected to the gate electrode of drive transistor $TD_R$ and capacitor $CS_R$.

One of the source electrode and the drain electrode of counter transistor $T4_R$ is connected between the other of the source electrode and the drain electrode of first write transistor $T31_R$ and one of the source electrode and the drain electrode of second write transistor $T32_R$. One of the source electrode and the drain electrode of counter transistor $T4_R$ is electrically connected to one of the source electrode and the drain electrode of first write transistor $T31_R$ and the other of the source electrode and the drain electrode of second write transistor $T32_R$. The other of the source electrode and the drain electrode of counter transistor $T4_R$ is connected to an intermediate node. The other of the source electrode and the drain electrode of counter transistor $T4_R$ is connected to counter voltage line VCNT which feeds counter voltage VCNT.

The node formed by counter transistor $T4_R$, the other of the source electrode and the drain electrode of first write transistor $T31_R$, and one of the source electrode and the drain electrode of second write transistor $T32_R$ is a so-called floating node (intermediate node). The node is also referred to as intermediate node. It can also be said that one of the source electrode and the drain electrode of counter transistor $T4_R$ is connected to the intermediate node. The voltage of the intermediate node is referred to as voltage Vb.

Counter transistor $T4_R$ is turned on when controlling voltage Vb, and is turned off when not controlling it. By turning on counter transistor $T4_R$, voltage Vb can be used as counter voltage VCNT. Thus, in the present embodiment, voltage Vb can be actively controlled using counter transistor $T4_R$. Specifically, voltage Vb is controlled such that source drain voltage $Vds_R$ of second write transistor $T32_R$ is reduced.

Capacitor $CS_R$ retains the voltage of data signal $Vdat_R$ fed through the voltage of data signal line $Vdat_R$.

Counter voltage line VCNT is one example of a voltage line which is disposed for each pixel row L and feeds a second voltage.

Figure 5:
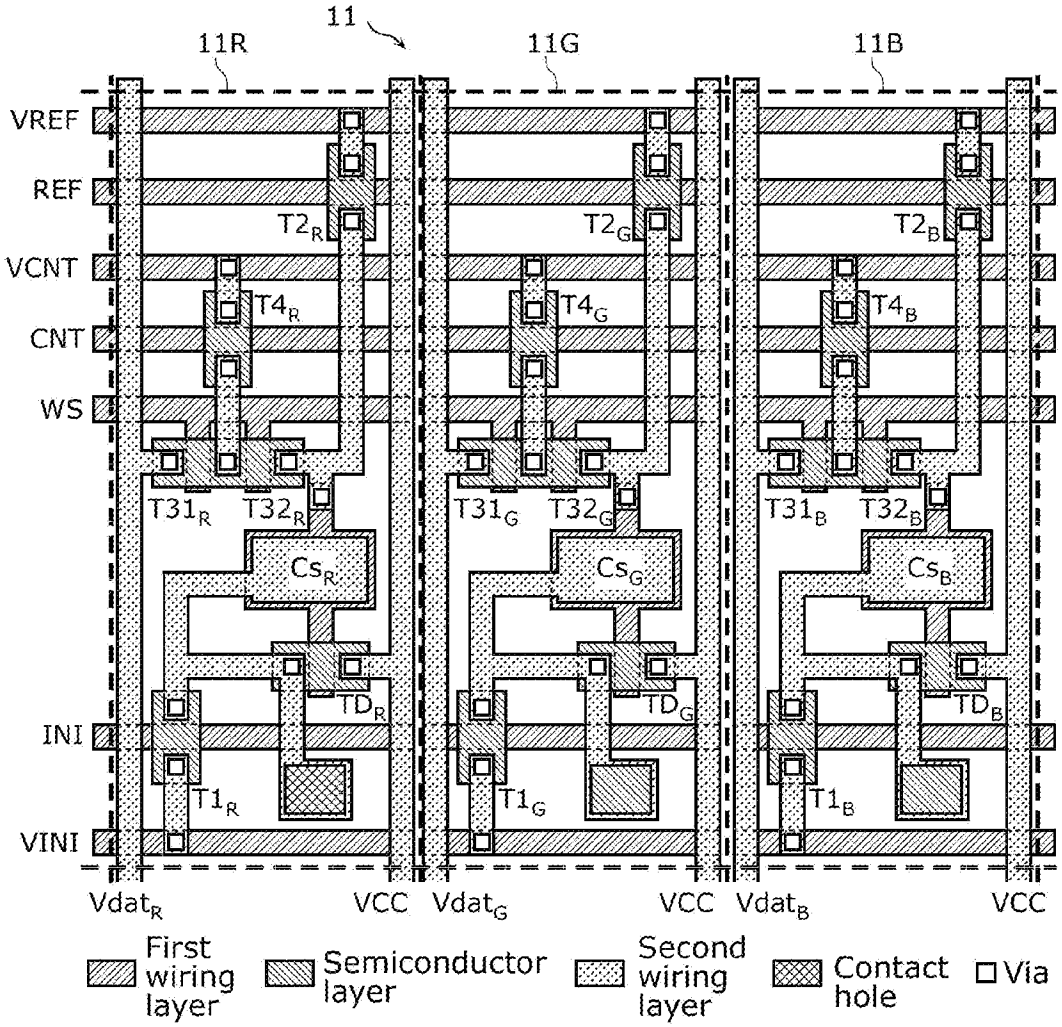
FIG. 5 is a plan view schematically illustrating one example of the structure of the pixel circuit according to the embodiment.

FIG. 5 is a plan view schematically illustrating one example of the structure of pixel circuit 11 according to the present embodiment. As illustrated in FIG. 5, subpixel circuits 11R, 11G, and 11B are disposed in subpixel regions 11R, 11G, and 11B defined by dividing pixel region 11 into three.

Pixel circuit 11 includes a first wiring layer, a semiconductor layer, and a second wiring layer disposed on a substrate in this order. The first wiring layer is mainly used as control signal lines INI, REF, WS, and CNT, reference voltage lines VINI and VREF, counter voltage line VCNT, one electrodes of capacitors $CS_R$, $CS_G$, and $CS_B$, and gate electrodes of the transistors. The semiconductor layer is used as channel regions of the transistors. The second wiring layer is mainly used as data signal lines $Vdat_R$, $Vdat_G$, and $Vdat_B$, positive power supply line VCC, the other electrodes of capacitors $CS_R$, $CS_G$, and $CS_B$, and source electrodes and drain electrodes of the transistors. Different layers are connected to each other through vias.

Light-emitting elements $EL_R$, $EL_G$, and $EL_B$ included in pixel circuit 11 emit light beams at the same timing according to the same control signals INI, REF, and WS at luminances corresponding to data signals $Vdat_R$, $Vdat_G$, and $Vdat_B$ retained in capacitor $CS_R$, $CS_G$, and $CS_B$, respectively.

Although not illustrated, a planarization layer is disposed to cover the substrate, the first wiring layer, the semiconductor layer, and the second wiring layer. Light-emitting elements $EL_R$, $EL_G$, and $EL_B$ are disposed on the planarization layer.

For example, display apparatus 100 may include a line memory (not illustrated) which stores picture data of one line or a frame memory (not illustrated) which stores picture data of one frame.

Although reference signs "R", "G", and "B" are given to the components corresponding to the subpixel circuits, reference numerals without "R", "G", and "B" will be given in some cases where the three subpixel circuits are not distinguished.

[2. Control of Counter Voltage]

Figure 8:
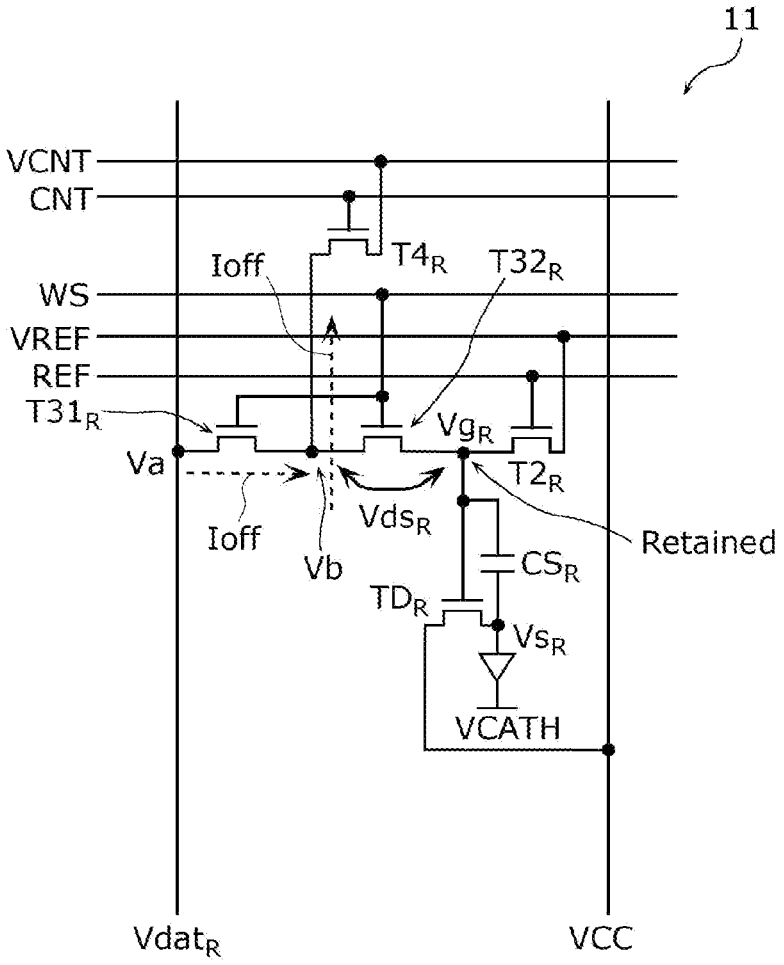
FIG. 8 is a diagram illustrating suppression of the off leakage current.

Next, control of the counter voltage in display apparatus 100 described above will be described with reference to FIGS. 6 to 11. FIG. 6 is a diagram illustrating one example of the gradation voltage according to the present embodiment. FIG. 7 is a diagram illustrating one example of counter voltage VCNT according to the present embodiment. The first killer pattern display shown in FIG. 7 corresponds to the display shown in FIG. 2A, and the second killer pattern display corresponds to the display shown in FIG. 2C. FIG. 8 is a diagram illustrating suppression of off leakage current Ioff. FIG. 8 illustrates pixel circuit 11R among pixel circuits 11R, 11G, and 11B. The same illustration also applies to pixel circuits 11G and 11B.

In the description below, controller 20 sets counter voltage VCNT based on a lookup table (LUT) stored in a storage (not illustrated), for example. The lookup table is, for example, a table in which at least one of the gradation voltage of a white pixel or the gradation voltage of a black pixel corresponds to counter voltage VCNT at that time. It can also be said that the lookup table is, for example, a table in which at least one of SIG voltage Va of data signal line Vdat or gate potential Vg corresponds to counter voltage VCNT at that time. In the first killer pattern display, the lookup table may be, for example, a table in which the gradation voltage of a black pixel corresponds to counter voltage VCNT at that time. For example, the lookup table may be a table generated to match counter voltage VCNT with gate potential Vg of a black pixel.

Counter voltage VCNT to be set will be described with reference to FIG. 6, where the gradation voltage in the black display (voltage of black gradation data) is defined as 0 V and the gradation voltage in the white display (voltage of white gradation data) is defined as 10 V. It is sufficient that the gradation voltage in the black display and the gradation voltage in the white display are set according to the video signal, and can be set at any other voltage other than 0 V and 10 V. Even when the gradation voltage in the black display and the gradation voltage in the white display are any other voltage other than 0 V and 10 V, display apparatus 100 according to the present embodiment is effective in suppressing off leakage current Ioff.

To be noted, the black display means a display of a low gradation voltage (such as the lowest gradation voltage or a gradation voltage close to the lowest gradation voltage), rather than the display of an ideal perfect black (luminance: 0 cd/m$^2$). For example, the black display is a display at a low gradation voltage which can be considered as substantially black, and can also be said to be a dark display. The white display means a display of a high gradation voltage (such as the highest gradation voltage or a gradation voltage close to the highest gradation voltage), rather than the display of an ideal perfect white. For example, the white display is a display at a high gradation voltage which can be considered as substantially white, and can also be said to be a bright display.

As shown in FIG. 7, controller 20 controls counter voltage VCNT of the pixel subjected to writing to be 0 V, when display apparatus 100 performs the first killer pattern display. In other words, controller 20 controls voltage Vb of the intermediate node in the pixel subjected to writing to be 0 V as the black display. Thereby, when a voltage of 10 V, which indicates SIG voltage Va corresponding to the white display, is being written to the white pixel in the white window, voltage Vb of the black pixel located above the white pixel is set to counter voltage VCNT of 0 V. Controller 20 sets counter voltage VCNT to reduce the difference in potential between the gradation voltage written to the pixel (such as the gradation voltage written to the black pixel) and counter voltage VCNT. For example, controller 20 sets counter voltage VCNT such that the difference in potential is zero.

Thus, controller 20 sets counter voltage VCNT of the pixel based on the gradation voltage written to the pixel. When counter voltage VCNT is set for each pixel row, controller 20 sets counter voltage VCNT of the pixel row based on the gradation voltages written to two or more pixels in the pixel row. For example, controller 20 sets counter voltage VCNT to reduce the difference in potential between the gradation voltages written to the two or more pixels in the pixel row and counter voltage VCNT.

At this time, as illustrated in FIG. 8, the difference in potential between SIG voltage Va and voltage Vb, i.e., 10 V is applied to first write transistor T31$_R$, that is, the source drain voltage of first write transistor T31$_R$ is 10 V. Thus, off leakage occurs in first write transistor T31$_R$. As a result, off leakage current Ioff flows from data signal line Vdat$_R$ through first write transistor T31$_R$ to second write transistor T32$_R$. Here, because the difference in potential between voltage Vb and gate potential Vg$_R$, i.e., 0 V is applied to second write transistor T32$_R$, that is, source drain voltage Vds$_R$ of second write transistor T32$_R$ is 0 V, off leakage hardly occurs in second write transistor T32$_R$. For this reason, off leakage current Ioff flowing in first write transistor T31$_R$ then flows through counter transistor T4$_R$ to counter voltage line VCNT.

Thus, source drain voltage Vds$_R$, which is the difference in potential between voltage Vb and gate potential Vg$_R$, is 0 V. For this reason, a flow of off leakage current Ioff in second write transistor T32$_R$ can be suppressed. As a result, gate potential Vg$_R$ of the black pixel located above the white pixel is retained at 0 V. In other words, occurrence of the black level degradation can be suppressed.

The voltage value here means substantially 0 V, using 0 V as an example. In other words, voltage Vb and gate potential Vg$_R$ may have a difference of several percent in potential.

When controller 20 is writing SIG voltage Va corresponding to the black display, i.e., 0 V to the black pixel located below a white pixel in the first killer pattern display, voltage Vb of the white pixel in the white window located above the black pixel is controlled to be counter voltage VCNT of 0 V.

Because the difference in potential between SIG voltage Va and potential Vb is 0 V at this time, off leakage current Ioff does not flow in first write transistor T31$_R$. Off leakage current Ioff here is a current flowing from capacitor CS$_R$ toward data signal line Vdat$_R$. As a result, gate potential Vg$_R$ of the white pixel located above the black pixel is retained at 10 V. Thus, occurrence of the white level reduction can be suppressed.

Controller 20 controls counter voltage VCNT of the pixel subjected to writing to be 10 V, when display apparatus 100 performs the second killer pattern display. In other words, controller 20 controls voltage Vb of the intermediate node of the pixel subjected to writing to be 10 V. Thereby, when SIG voltage Va corresponding to the black display, i.e., 0 V is being written to the black pixel in the black window, voltage Vb of the white pixel located above the black pixel is controlled to be counter voltage VCNT of 10 V.

Because the difference (i.e., 10 V) in potential between SIG voltage Va and potential Vb is applied to first write transistor T31$_R$ at this time, that is, the source drain voltage of first write transistor T31$_R$ is 10 V, off leakage occurs in first write transistor T31$_R$. As a result, off leakage current Ioff flows from counter voltage line VCNT through first write transistor T31$_R$ toward data signal line Vdat$_R$.

Here, because the difference (i.e., 0 V) in potential between voltage Vb and gate potential Vg$_R$ is applied to second write transistor $T32_R$, that is, source drain voltage $Vds_R$ of second write transistor $T32_R$ is 0 V, off leakage hardly occurs in second write transistor $T32_R$. For this reason, a flow of off leakage current Ioff from the gate node through second write transistor $T32_R$ toward first write transistor $T31_R$ can be suppressed.

Thus, source drain voltage $Vds_R$, which is the difference in potential between voltage Vb and gate potential $Vg_R$, is 0 V. For this reason, the flow of off leakage current Ioff in second write transistor $T32_R$ can be suppressed. As a result, gate potential $Vg_R$ of the white pixel located above the black pixel is retained at 10 V. In other words, occurrence of the white level reduction can be suppressed.

When controller 20 is writing SIG voltage Va corresponding to the white display (i.e., 10 V) to a white pixel located below a black pixel in the second killer pattern display, voltage Vb of the black pixel in the black window located above the white pixel is controlled to be counter voltage VCNT of 10 V.

Because the difference in potential between SIG voltage Va and potential Vb is 0 V at this time, off leakage current Ioff does not flow in first write transistor $T31_R$. Off leakage current Ioff here is a current flowing from data signal line $Vdat_R$ toward capacitor $CS_R$. As a result, gate potential $Vg_R$ of the black pixel located above the white pixel is retained at 0 V. Thus, occurrence of the black level degradation can be suppressed.

FIG. 9 is a diagram illustrating the results of comparison in leakage amount between display apparatus 100 according to the present embodiment and the display apparatus according to the conventional example. FIG. 9 shows the voltage of a black pixel located above a white pixel when SIG voltage Va of 10 V, which corresponds to the white display, is being written to the white pixels in the white window in the first killer pattern display. The leakage amount in the second killer pattern display also has a similar tendency to that shown in FIG. 9. The display apparatus according to the conventional example shown in FIG. 9 includes pixel circuit 211 illustrated in FIG. 1. The numeric values shown in FIG. 9 are exemplary, and can be any other numeric values. For example, counter voltage VCNT may be appropriately set to reduce (for example, minimize) off leakage current Ioff.

As shown in FIG. 9, in the display apparatus according to the conventional example, SIG voltage Va is 10 V, and gate node Vg (gate potential Vg) is 0 V (equivalent to black SIG voltage). The expression "equivalent to black SIG voltage" indicates a voltage corresponding to the black display. At this time, source drain voltage Vds of write transistor T3 is 10 V ([SIG voltage Va (10 V)]-[gate potential Vg (0 V)]). Thus, off leakage current Ioff flowing in write transistor T3 is larger than that in pixel circuit 11, resulting in a "large" leakage amount of the leakage current flowing in write transistor T3. Because pixel circuit 211 does not include counter transistor T4 and the like, there is no counter voltage VCNT ("None" as shown in FIG. 9).

In contrast, in display apparatus 100 according to the present embodiment, SIG voltage Va is 10 V, voltage Vb is 0 V, and gate node Vg (gate potential Vg) is 0 V (equivalent to black SIG voltage). At this time, source drain voltage Vds of second write transistor T32 is 0 V ([voltage Vb (0 V)]−[gate potential Vg (0 V)]). Thus, off leakage current Ioff flowing in second write transistor $T32_R$ is smaller than that in pixel circuit 211, resulting in a "small" leakage amount of the leakage current flowing in second write transistor T32.

Accordingly, when the first and second killer pattern displays are performed, display apparatus 100 according to the present embodiment can have a reduced leakage amount of off leakage current Ioff compared to that in the display apparatus according to the conventional example, and can retain the written gate potential Vg. In other words, display apparatus 100 can have improved display quality compared to that of the display apparatus not including counter transistor T4 and the like.

Figure 10:
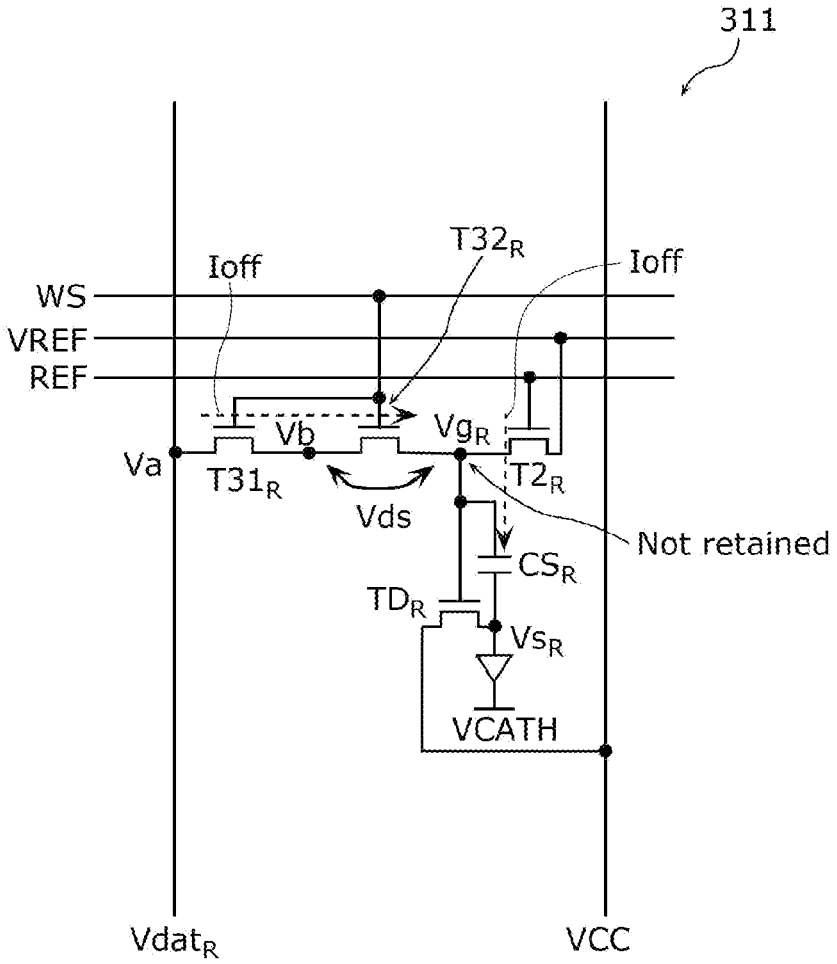
FIG. 10 is a diagram illustrating the flow of the off leakage current in the pixel circuit according to another conventional example.

Here, comparison to the pixel circuit according to another conventional example will be described with reference to FIG. 10. FIG. 10 is a diagram illustrating a flow of off leakage current Ioff in pixel circuit 311 according to another conventional example. FIG. 10 illustrates the flow of off leakage current Ioff when a double gate transistor is used as the write transistor. Specifically, pixel circuit 311 includes first write transistor $T31_R$ and second write transistor $T32_R$. FIG. 10 illustrates a subpixel circuit in pixel circuit 311 according to another conventional example, the subpixel corresponding to subpixel circuit 11R according to the present embodiment. Unlike pixel circuit 11, pixel circuit 311 does not include counter transistor T4 and the like.

FIG. 10 illustrates the flow of off leakage current Ioff in pixel circuit 311 of a black pixel located above a white pixel in the case where SIG voltage Va corresponding to the white display, i.e., 10 V is being written to the white pixel in the white window when the first killer pattern display is performed.

As illustrated in FIG. 10, voltage Vb of the intermediate node located between first write transistor $T31_R$ and second write transistor $T32_R$ is approximately an intermediate voltage between SIG voltage Va and gate potential $Vg_R$. In this case, SIG voltage Va is 10 V, and gate potential $Vg_R$ is 0 V; then, voltage Vb is about 5 V. Thus, in pixel circuit 311, voltage Vb is a value based on SIG voltage Va and gate potential $Vg_R$, and cannot be actively set.

In this case, source drain voltage Vds of second write transistor $T32_R$ corresponds to the difference in potential between voltage Vb and gate potential $Vg_R$. In the case of FIG. 10, source drain voltage Vds of second write transistor $T32_R$ is 5 V ([voltage Vb (5 V)]− [gate potential Vg (0 V)]). For this reason, off leakage current Ioff corresponding to source drain voltage Vds (5 V) flows in second write transistor $T32_R$. Thus, gate potential $Vg_R$ of the black pixel located above the white pixel is not retained at 0 V. To be noted, pixel circuit 311 can reduce off leakage current Ioff compared to pixel circuit 211. Pixel circuit 311 cannot minimize off leakage current Ioff because control of voltage Vb is not enabled. In pixel circuit 311, the value of voltage Vb is varied among the pixels because control of voltage Vb is not enabled. This results in an increased variation in leakage amount among the pixels. Such a large variation in leakage amount may reduce the display quality of the display apparatus.

In contrast, controller 20 according to the present embodiment can arbitrarily set voltage Vb of the intermediate node by adjusting counter voltage VCNT. For example, by setting voltage Vb as the voltage which enables a reduction in leakage amount (for example, minimization of the leakage amount), controller 20 can further reduce off leakage current Ioff in pixel circuit 11 compared to that in pixel circuit 311 according to another Comparative Example. Off leakage hardly occurs in second write transistor T32 in pixel circuit 11 even when off leakage current Ioff flows in first write transistor T31, thus suppressing influences of off leakage current Ioff over gate potential Vg (that is, the voltage retained in capacitor $CS_R$). Moreover, pixel circuit 11 can minimize off leakage current Ioff because control of voltage Vb is enabled. In pixel circuit 11, the pixels can have a constant value of voltage Vb because control of voltage Vb is enabled, thus resulting in a small variation in leakage amount among the pixels. Because such a variation in leakage amount can be suppressed, display apparatus 100 can suppress a reduction in display quality.

Subsequently, another example of control of counter voltage VCNT will be described with reference to FIGS. 11 to 13. FIG. 11 is a diagram illustrating another example of the gradation voltage according to the present embodiment. FIG. 11 shows the gradation voltage in a standard display other than the killer pattern.

The setting of counter voltage VCNT will be described with reference to FIG. 11, where the gradation voltage of the black display (voltage of black gradation data) is 0 V and the gradation voltage of the white display (voltage of white gradation data) is 10 V. The intermediate gradation voltage between the white display and the black display is calculated based on the gradation voltage of the black display and the gradation voltage of the white display. For example, the intermediate gradation voltage may be a median of the gradation voltage of the black display and the gradation voltage of the white display. In the case of FIG. 11, the intermediate gradation voltage is 5 V. For example, the gradation voltage in the white display may be a voltage corresponding to the maximum luminance in one frame of image. For example, the gradation voltage in the black display may be a voltage corresponding to the minimum luminance in one frame of image. The intermediate gradation voltage is not limited to the median of the white display and the gradation voltage of the black display, and may be calculated based on the gradation voltages of the pixel rows or all the pixels. For example, the intermediate gradation voltage may be the average of the gradation voltages of the pixel rows or all the pixels, or may be a most frequent value among them. The gradation voltage in the black display may be the average of the gradation voltages of the pixels which perform the black display, and the gradation voltage in the white display may be the average of the gradation voltages of the pixels which perform the white display.

The setting of counter voltage VCNT at this time will be described with reference to FIG. 12. FIG. 12 is a diagram illustrating another example of counter voltage VCNT according to the present embodiment. In the following description, counter voltage VCNT in FIG. 12 is set at the median of the gradation voltage of a pixel which performs the black display (such as a pixel which performs the darkest display) and the gradation voltage of a pixel which performs the white display (such as a pixel which performs the brightest display) among a plurality of pixels in the pixel row. Although an example in which counter voltage VCNT is set for each of the pixel rows will be described below, counter voltage VCNT can be set in any other manner.

As shown in FIG. 12, controller 20 may change counter voltage VCNT according to the gradation voltage corresponding to the image, for example. For example, controller 20 may change counter voltage VCNT according to the display pattern of the image (such as the distribution of luminance). It can also be said that controller 20 sets the counter voltage VCNT of the pixel row based on the gradation voltages of the pixels in the pixel row, for example.

For example, when the image is a natural image, controller 20 sets counter voltage VCNT to an intermediate gradation voltage between the gradation voltage of the black display and the gradation voltage of the white display. In the case of the example shown in FIG. 11, counter voltage VCNT is 5 V. Counter voltage VCNT of 5 V is applied to each of the pixels in the pixel row. When counter voltage VCNT is set for each of the pixel rows, as counter voltage VCNT, controller 20 sets an intermediate gradation voltage between the gradation voltage of a pixel which performs the white display and the gradation voltage of a pixel which performs the black display, among two or more pixels in the pixel row.

Thereby, off leakage current Ioff in a bright pixel and that in a dark pixel can be suppressed in a balanced manner. In other words, a reduction in display quality of the bright pixel and that of the dark pixel can be suppressed. The bright pixel is a pixel having a gradation voltage between the gradation voltage of the black display and the intermediate gradation voltage shown in FIG. 11, for example. The dark pixel is a pixel having a gradation voltage between the intermediate gradation voltage and the gradation voltage of the white display shown in FIG. 11, for example.

The natural image indicates an image in which the change amount between pixel values of adjacent pixels (change amount between gradation voltages thereof) is less than a predetermined change amount, for example. In other words, the natural image indicates an image in which adjacent pixels have continuous pixel values. When counter voltage VCNT of the pixel row is set based on the gradation voltage of the pixel row, the natural image indicates an image in which the change amount between pixel values of adjacent pixels is less than a predetermined change amount in the pixel row.

When the image is a black-tone image, controller 20 sets counter voltage VCNT to a gradation voltage between the gradation voltage of the black display and the intermediate gradation voltage, for example. When the image is a black-tone image, controller 20 sets counter voltage VCNT to a median of the gradation voltage of the black display and the intermediate gradation voltage. In the case of the example of FIG. 11, counter voltage VCNT is 2.5 V. Counter voltage VCNT of 2.5 V is applied to each of the pixels in the pixel row.

In such a configuration, when many pixels perform the black display, off leakage current Ioff in the black pixels which perform the black display can be significantly suppressed. In other words, occurrence of the black level degradation can be suppressed, improving the display quality of display apparatus 100. For example, the display quality of movies can be effectively improved.

The black-tone image indicates an image in which the proportion of the pixel which performs the black display is 50% or more. When counter voltage VCNT of the pixel row is set based on the gradation voltage of the pixel row, the black-tone image indicates an image (pixel row) in which the proportion of the pixel which performs the black display is 50% or more in the pixel row. The proportion of the pixel which performs the black display is not limited to 50%. The proportion of the pixel which performs the black display is one example of a first proportion.

For example, when the image is the white-tone image, controller 20 sets counter voltage VCNT to a gradation voltage between the gradation voltage of the white display and the intermediate gradation voltage. For example, when the image is the white-tone image, controller 20 sets counter voltage VCNT to a median of the gradation voltage of the white display and the intermediate gradation voltage. In the case of the example of FIG. 11, counter voltage VCNT is 7.5 V. Counter voltage VCNT of 7.5 V is applied to each of the pixels in the pixel row.

In such a configuration, when many pixels perform the white display, off leakage current Ioff of the white pixels which perform the white display can be significantly suppressed. In other words, controller 20 can suppress the occurrence of the white level reduction, thus improving the display quality of display apparatus 100. For example, the display quality in images having a small difference in gradation can be effectively improved.

The white-tone image indicates an image in which the proportion of the pixel which performs the white display is 50% or more, for example. When counter voltage VCNT of the pixel row is set based on the gradation voltage of the pixel row, the white-tone image indicates an image (pixel row) in which the proportion of the pixel which performs the white display is 50% or more in the pixel row. The proportion of the pixel which performs the white display is not limited to 50%. The proportion of the pixel which performs the white display is one example of a second proportion.

Thus, controller 20 sets counter voltage VCNT based on the gradation voltage written to the pixel which performs the black display when among the two or more pixels in the pixel row, the proportion of the pixel which performs the black display is higher than or equal to the first proportion, and sets counter voltage VCNT based on the gradation voltage written to the pixel which performs the white display when among the two or more pixels in the pixel row, the proportion of the pixel which performs the white display is higher than or equal to the second proportion.

Controller 20 may set counter voltage VCNT in any manner than setting for each of the pixel rows. Controller 20 may set all the pixels to the same counter voltage VCNT. In this case, based on the voltages (gradation voltages) of data signals Vdat of all the pixels in one frame of image, controller 20 may determine whether the image is the natural image, the black-tone image, or the white-tone image, and may set one of counter voltages VCNT based on the result of determination. Based on the voltages of data signals Vdat written to a plurality of pixels, controller 20 may set counter voltage VCNT identical among the plurality of pixels. In this case, counter voltage VCNT is set for each frame, thus improving the display quality in real-time.

Figure 13:
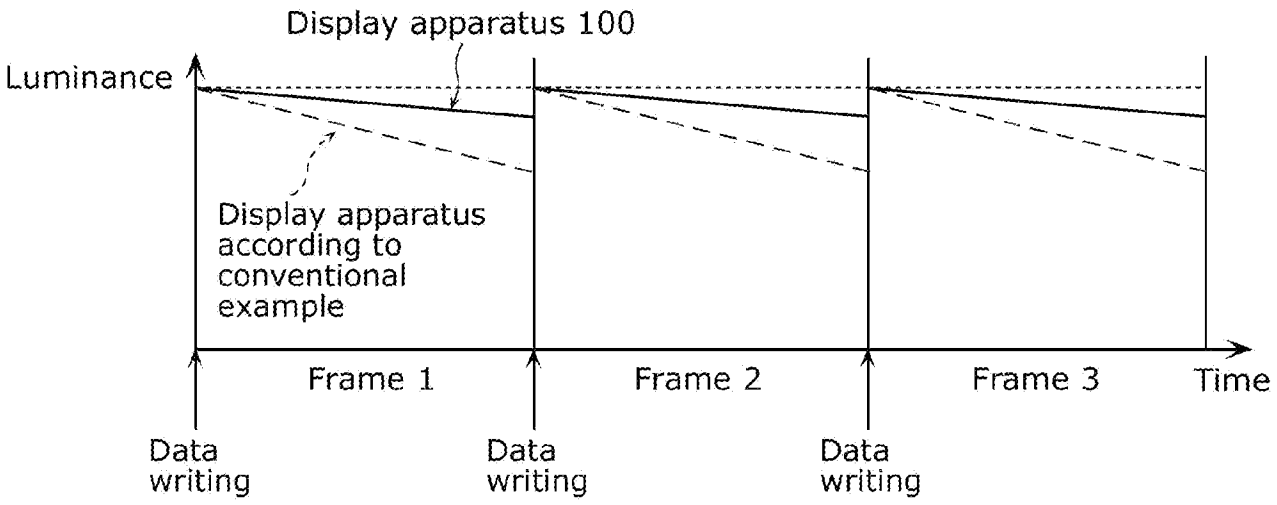
FIG. 13 is a diagram schematically illustrating changes in luminance in the display apparatus according to the embodiment and the display apparatus according to the conventional example.

FIG. 13 is a diagram schematically illustrating a change in luminance in display apparatus 100 according to the present embodiment and the display apparatus according to the conventional example. The display apparatus according to the conventional example corresponds to the display apparatus in FIG. 1 including pixel circuit 211. FIG. 13 illustrates a change in luminance of a white pixel within a frame, the white pixel being included in the pixel row initially subjected to data writing within the frame. The data writing indicates writing of the voltage corresponding to the white display to the white pixel.

As illustrated in FIG. 13, after the data writing, the luminance is reduced in display apparatus 100 according to the present embodiment and the display apparatus according to the conventional example. Such a reduction is caused for the following reason: Other pixel rows are sequentially subjected to data writing while the white pixel after the data writing is emitting light (see FIG. 15). Off leakage current Ioff flows in the write transistor of the white pixel during the data writing to other pixel rows. As a result, the retained voltage of the white pixel gradually reduces.

Display apparatus 100 according to the present embodiment can suppress the occurrence of off leakage current Ioff by controlling voltage Vb of the intermediate node by counter voltage VCNT, and can more significantly suppress a change in luminance than that in the display apparatus according to the conventional example. In other words, display apparatus 100 according to the present embodiment has further improved display quality compared to that of the display apparatus according to the conventional example.

Because off leakage current Ioff occurs in each frame, the luminance in each frame is reduced. Display apparatus 100 according to the present embodiment can suppress the occurrence of off leakage current Ioff in each frame, and can more significantly suppress a change in luminance in each frame than that in the display apparatus according to the conventional example.

Thus, display apparatus 100 according to the present embodiment can improve the display quality in both still pictures and moving pictures.

Although an example in which the luminance is uniformly reduced within the frame has been shown in FIG. 13, the change in luminance is not limited to this. The luminance may be increased according to the image. The change in luminance may be varied among the frames.

Figure 14:
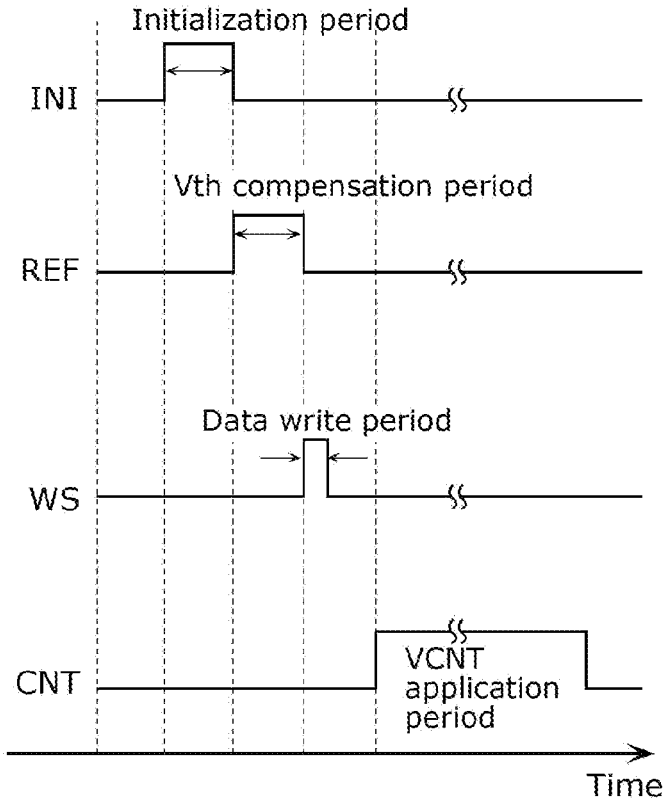
FIG. 14 is a timing chart illustrating one example of a method of driving a subpixel circuit according to the embodiment.

FIG. 14 is a timing chart illustrating one example of a method of driving the subpixel circuit according to the present embodiment. FIG. 14 illustrates a timing chart for one subpixel circuit.

As illustrated in FIG. 14, in the subpixel circuit (such as subpixel circuit 11R), data signal Vdat associated with the luminance of the subpixel circuit is retained in capacitor CS through data signal line Vdat (the initialization period, the Vth compensation period, and the data write period). A current according to data signal Vdat retained in capacitor CS is output from drive transistor TD. The VCNT application period is a period after the data write period in the frame. The VCNT application period is started during a period after the data write period of the current pixel row and before the start of the data write period of the pixel row immediately below the current pixel row.

The operation shown in FIG. 14 is executed at the same timing in three subpixel circuits 11R, 11G, and 11B included in pixel circuit 11.

Figure 15:
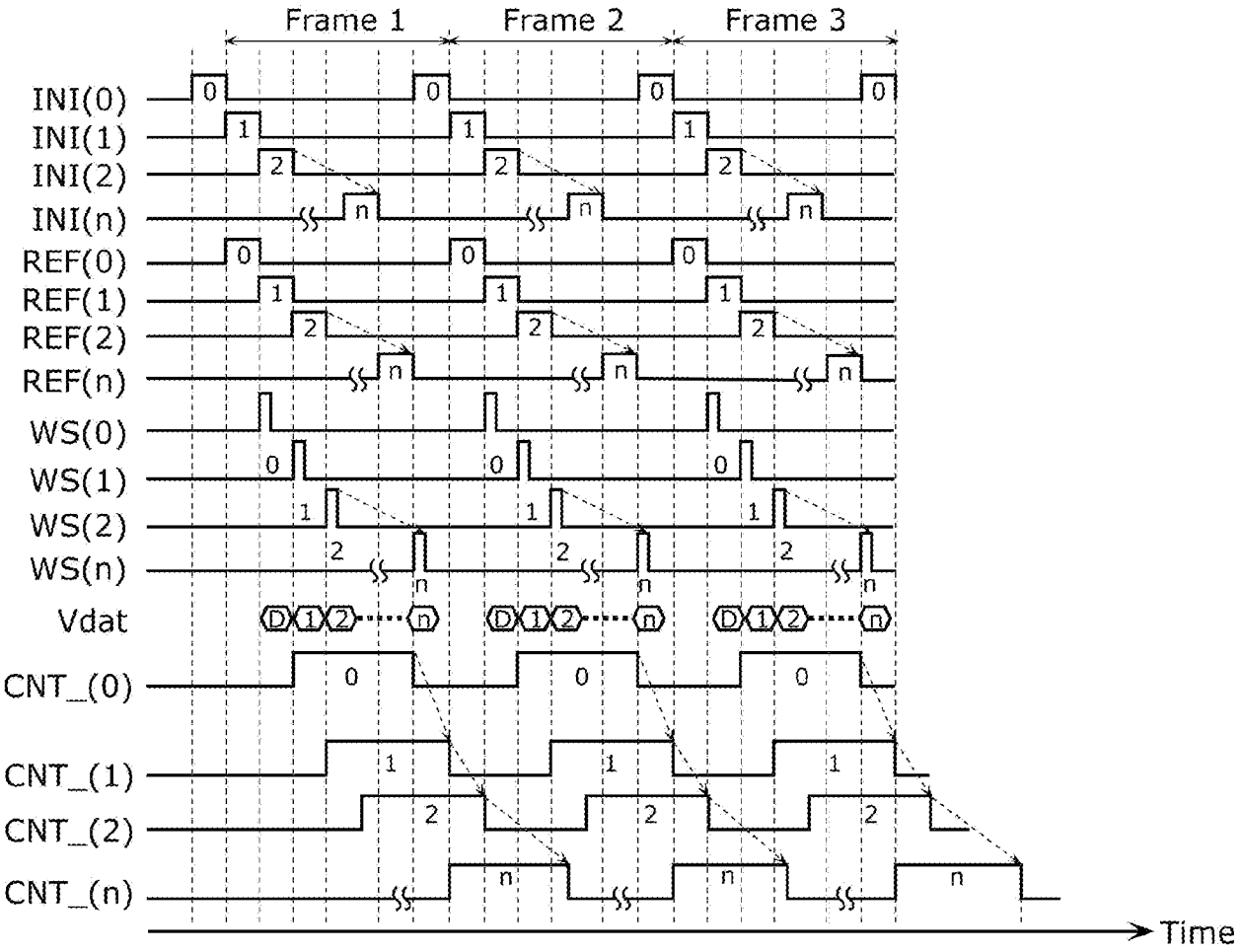
FIG. 15 is a timing chart illustrating one example of a method of driving the display apparatus according to the embodiment.

FIG. 15 is a timing chart illustrating one example of a method of driving display apparatus 100 according to the present embodiment. In FIG. 15, bracketed numbers given to the signal names each represent the pixel row to which the signal is fed.

As illustrated in FIG. 15, the operation of the subpixel circuit shown in FIG. 14 is sequentially performed on the subpixel circuits included in all the rows 0 to n in display apparatus 100. For convenience, an example in which writing to pixel row 0 is completed and writing to pixel row 1 is performed will be described below.

Controller 20 feeds counter voltage VCNT to pixel row 0 after the initialization period, the Vth compensation period, and the write period in pixel circuit 11 of pixel row 0 and before the start of the write period in pixel circuit 11 of the subsequent pixel row 1 (before turning on of WS(1) in the frame). An equal counter voltage VCNT is fed to each of pixels included in pixel row 0.

Controller 20 feeds counter voltage VCNT, which is set based on the image, to counter voltage line VCNT, and turns on counter transistor T4 included in pixel circuit 11 of pixel row 0 after the write period (after turning off of WS(0)) in pixel circuit 11 of pixel row 0 and before the start of the write period in pixel circuit 11 of pixel row 1. Controller 20 turns off counter transistor T4 when pixel row 0 reaches the next initialization period.

Thus, controller 20 maintains the on-state of counter transistor T4 during the period from the end of the write period in pixel row 0 to the start of the next initialization period in pixel row 0 (for example, see the periods represented by "0" during which CNT_(0) is on, as shown in FIG.

15). For example, it can also be said that controller 20 maintains the on-state of counter transistor T4 during the light-emitting period in pixel row 0. To be noted, counter voltage VCNT fed during the period is a constant voltage, for example.

Counter transistor T4 is off during the initialization period, the Vth compensation period, and the write period. Controller 20 maintains the off-state of counter transistor T4 during the period from the start of the initialization period to the end of the write period. For this reason, voltage Vb of the intermediate node is not subjected to control by counter voltage VCNT during the initialization period, the Vth compensation period, and the write period.

Thereby, gate potential Vg of pixel circuit 11 of pixel row 0 is retained at the written voltage even when off leakage current Ioff flows in pixel circuit 11 of pixel row 0 during the writing operation in pixel row 1 and the pixel rows thereafter.

For example, in pixel row 2 and the pixel rows thereafter, the on-state of counter transistor T4 is retained across the frames. Even when the on-state is maintained across the frames, counter voltage VCNT during that period is constant, for example.

Although an example in which controller 20 maintains the on-state of counter transistor T4 during the light-emitting period in the pixel row has been described above, controller 20 may maintain the on-state of counter transistor T4 during any other period. Controller 20 may maintain the on-state of counter transistor T4 during at least part of the light-emitting period in the pixel row. Alternatively, controller 20 may turn on counter transistor T4 several times during the light-emitting period in the pixel row. In other words, controller 20 may turn on and off counter transistor T4 several times during the light-emitting period in the pixel row.

[3. Effects]

As described above, display apparatus 100 according to the present embodiment is display apparatus 100 including pixels (pixel circuits 11) two-dimensionally arranged. Each of the pixels includes light-emitting element EL; capacitor CS which retains a voltage (one example of a first voltage) of data signal Vdat fed through data signal line Vdat (one example of the signal line); drive transistor TD which feeds a current according to the voltage of data signal Vdat to light-emitting element EL; first write transistor T31 which includes a source electrode and a drain electrode and is connected between data signal line Vdat and a gate electrode of drive transistor TD, one of the source electrode and the drain electrode being connected to data signal line Vdat; second write transistor T32 connected between (i) the other of the source electrode and the drain electrode of first write transistor T31 and (ii) a gate electrode of drive transistor TD; and counter transistor T4 including one of a source electrode and a drain electrode, one of the source electrode and the drain electrode being connected between (iii) the other of the source electrode and the drain electrode of first write transistor T31 and (iv) one of a source electrode and a drain electrode of second write transistor T32, the other of the source electrode and the drain electrode of counter transistor T4 being connected to counter voltage line VCNT (one example of the voltage line) which feeds counter voltage VCNT (one example of second voltage).

In such a configuration, display apparatus 100 can feed counter voltage VCNT through counter transistor T4 to an intermediate node between first write transistor T31 and second write transistor T32. By feeding counter voltage VCNT to the intermediate node to reduce source drain voltage Vds of second write transistor T32, the off leakage in second write transistor T32 of the pixel caused during the write period in another pixel can be suppressed. In other words, the voltage retained in capacitor CS of the pixel (the written voltage) can be maintained. Thus, display apparatus 100 reduces a variation in voltage retained in capacitor CS, and can further improve the display quality compared to the case where the voltage retained in capacitor CS is varied.

Counter voltage line VCNT may be disposed in each of pixel rows. Display apparatus 100 may further include controller 20 which sets counter voltage VCNT of the pixel row based on the voltage of data signal Vdat written to two or more pixels in the pixel row.

In such a configuration, counter voltage VCNT is set based on the written voltage of data signal Vdat. Thus, controller 20 can suppress a variation in the written voltage of data signal Vdat (retained voltage retained in capacitor CS). As a result, the display quality can be improved.

Controller 20 sets counter voltage VCNT to reduce a difference in potential between the voltage of data signal Vdat and counter voltage VCNT, the voltage being written to the two or more pixels in the pixel row.

In such a configuration, counter voltage VCNT is set to reduce source drain voltage Vds of second write transistor T32. A reduction in source drain voltage Vds can more significantly suppress the occurrence of off leakage in second write transistor T32. Thus, the display quality can be further improved.

Controller 20 sets an intermediate voltage between a voltage of data signal Vdat written to a pixel which performs white display and a voltage of data signal Vdat written to a pixel which performs black display to counter voltage VCNT, the pixel which performs the white display and the pixel which performs the black display being included in the two or more pixels in the pixel row.

In such a configuration, off leakage current Ioff of the pixels which perform the black display and that of the pixels which perform the white display can be suppressed in a balanced manner, thus suppressing a variation in luminance. Thus, the display quality can be improved in the cases where the pixels which perform the black display and the pixels which perform the white display are displayed.

Controller 20 sets counter voltage VCNT, based on the voltage of data signal Vdat written to a pixel which performs the black display when among the two or more pixels in the pixel row, the proportion of the pixel which performs the black display is higher than or equal to 50% (one example of first proportion), and sets counter voltage VCNT based on the voltage of data signal Vdat written to a pixel which performs the white display when among the two or more pixels in the pixel row, the proportion of the pixel which performs the white display is higher than or equal to a second proportion.

In such a configuration, when many pixels perform the black display, off leakage current Ioff of the pixels can be suppressed, thus suppressing a variation in luminance of mainly the pixels which perform the black display. When many pixels perform the white display, off leakage current Ioff of the pixels can be suppressed, thus suppressing a variation in luminance of mainly the pixels which perform the white display. Thus, the display quality can be improved in a display such that many pixels perform the black display or many pixels perform the white display.

Display apparatus 100 may further include controller 20 which sets counter voltage VCNT identical among the pixels, based on the voltage of data signal Vdat written to each of the pixels.

Such a configuration can provide a simpler configuration of the circuit for feeding counter voltage VCNT than in the case where counter voltage VCNT is set for each of the pixel rows.

Controller 20 maintains an on-state of counter transistor T4 during a period from an end of a write period for retaining the voltage of data signal Vdat in capacitor CS to a start of an initialization period for initializing drive transistor TD of each of the pixels.

In such a configuration, while other pixel rows are sequentially undergoing writing, counter voltage VCNT is fed to the intermediate node between first write transistor T31 and second write transistor T32. In other words, while other pixel rows are sequentially undergoing writing, source drain voltage Vds of second write transistor T32 can be reduced. Thus, display apparatus 100 can suppress off leakage of second write transistor T32 while other pixel rows are sequentially undergoing writing, further improving the display quality.

(Modification of Embodiment)

Figure 16:
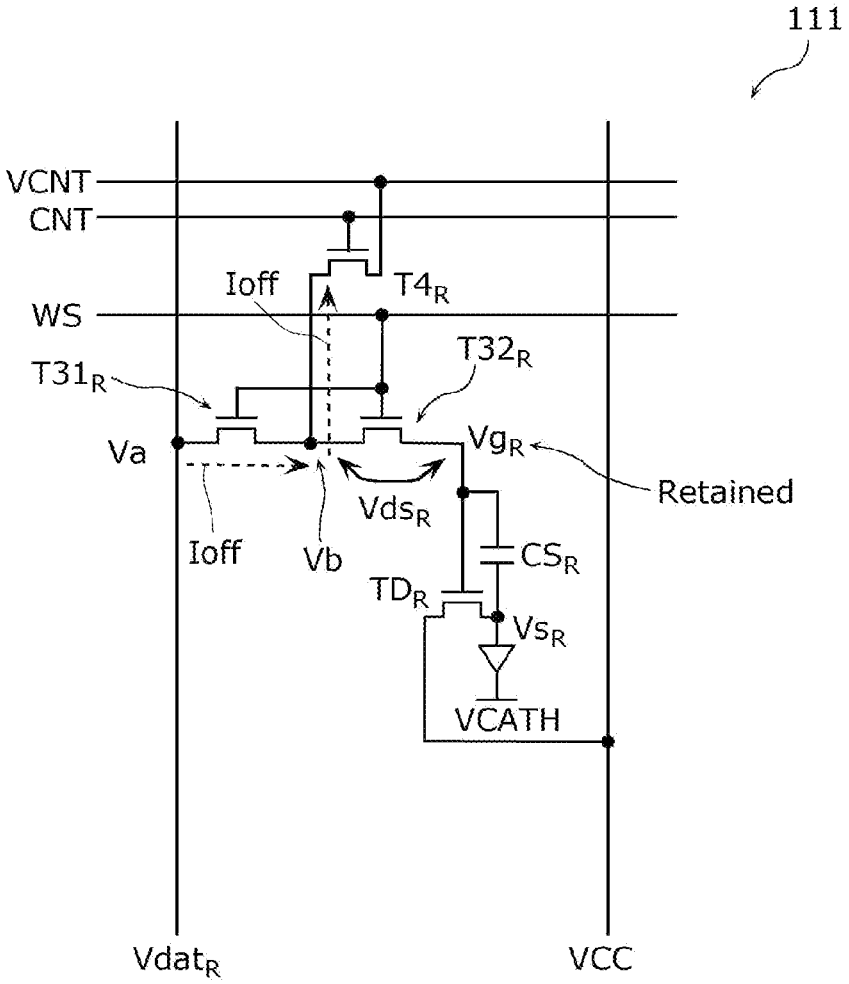
FIG. 16 is a circuit diagram illustrating one example of the configuration of the pixel circuit according to a modification of the embodiment.

A configuration of the pixel circuit according to the present modification will be described with reference to FIG. 16. FIG. 16 is a circuit diagram illustrating one example of the configuration of pixel circuit 111 according to the present modification. Identical reference numerals will be given to identical configurations to those in pixel circuit 11 according to the embodiment, and the description thereof will be omitted or simplified.

As illustrated in FIG. 16, unlike pixel circuit 11 according to the embodiment, pixel circuit 111 according to the present modification does not include initialization transistor $T1_R$ and compensation transistor $T2_R$. As above, pixel circuit 111 having a simpler configuration without initialization transistor $T1_R$ and compensation transistor $T2_R$ can also suppress a variation in the written retained voltage (gate potential $Vg_R$) caused by off leakage current Ioff. Off leakage current Ioff flowing in first write transistor $T31_R$ flows toward counter voltage line VCNT through counter transistor $T4_R$. Thus, display apparatus 100 including pixel circuit 111 can also improve the display quality.

In this case, controller 20 starts application of counter voltage VCNT to each of the pixels in the pixel row (turns on counter transistor T4) after the end of the write period in the current frame of the pixel row, and ends the application of counter voltage VCNT (turns off counter transistor T4) at a timing when the write period is started in the pixel row in the next frame.

Other Embodiments

Although the display apparatus according to the present disclosure has been described as above based on the embodiment, the embodiment should not be construed as limitations to the display apparatus according to the present disclosure. The present disclosure also covers other embodiments implemented with combinations of any components in the embodiment, modifications of the embodiment made by persons skilled in the art without departing from the gist of the present disclosure, and a variety of apparatuses including the display apparatus according to the present embodiment.

For example, although an example in which controller 20 sets counter voltage VCNT using a lookup table has been described in the embodiment and the like, counter voltage VCNT can be set by any other method. For example, controller 20 may set counter voltage VCNT by performing a predetermined arithmetic operation on the gradation voltage of each pixel in at least one pixel row in one frame of image. For example, controller 20 may set counter voltage VCNT by performing a predetermined arithmetic operation on the gradation voltage of each image of one frame.

Although an example in which the pixel circuit includes two write transistors has been described in the embodiment and the like, the number of write transistors is not limited to this. The pixel circuit may include three or more write transistors. In this case, one of the source electrode and the drain electrode of the counter transistor is connected to enable adjustment of the source drain voltage of the write transistor connected to the gate node. One of the source electrode and the drain electrode of the counter transistor is connected to an intermediate node between the write transistor connected to the gate node and another write transistor connected to the write transistor.

The lookup table in the embodiment and the like may be a table generated to match counter voltage VCNT with gate potential Vg of the white pixel.

Use of the display apparatus according to the embodiment and the like is not particularly limited. The display apparatus may be used in mobile information terminals, personal computers, and television sets, or may be used in digital signages.

The components in the embodiment and the like may be configured with dedicated hardware, or may be implemented by executing a software program suitable for each of the components. Each of the components (such as the controller) may be implemented by a program executor such as a processor which reads out and executes a software program recorded in a recording medium such as a hard disk or a semiconductor memory. The processor is configured with one or two or more electronic circuits including a semiconductor integrated circuit (IC) or large scale integration (LSI). The two or more electronic circuits may be integrated on a single chip, or may be disposed on a plurality of chips. The plurality of chips may be integrated into a single device, or may be included in two or more devices.

Although only some exemplary embodiments of the present disclosure have been described in detail above, those skilled in the art will readily appreciate that many modifications are possible in the exemplary embodiments without materially departing from the novel teachings and advantages of the present disclosure. Accordingly, all such modifications are intended to be included within the scope of the present disclosure.

INDUSTRIAL APPLICABILITY

The present disclosure can be widely used in display apparatuses.

The invention claimed is:

1. A display apparatus, comprising:

pixels two-dimensionally arranged, wherein each of the pixels includes:

a light-emitting element;

a capacitance element which retains a first voltage fed through a signal line;

a drive transistor which feeds a current according to the first voltage to the light-emitting element;

a first write transistor which includes a source electrode and a drain electrode and is connected between the signal line and a gate electrode of the drive transistor, one of the source electrode and the drain electrode being connected to the signal line;

a second write transistor connected between (i) an other of the source electrode and the drain electrode of the first write transistor and (ii) the gate electrode of the drive transistor; and a counter transistor including a source electrode and a drain electrode, one of the source electrode and the drain electrode being connected between (iii) the other of the source electrode and the drain electrode of the first write transistor and (iv) one of a source electrode and a drain electrode of the second write transistor, an other of the source electrode and the drain electrode of the counter transistor being connected to a voltage line which feeds a second voltage, the voltage line is disposed in each of pixel rows, the display apparatus further comprises a controller which sets, for each pixel row of the pixel rows, the second voltage of the pixel row, based on the first voltage written to two or more pixels in the pixel row, and the controller sets an intermediate voltage between the first voltage written to a first pixel which performs white display and the first voltage written to a second pixel which performs black display as the second voltage, the first pixel which performs the white display and the second pixel which performs the black display being included in the two or more pixels in the pixel row.

2. The display apparatus according to claim 1, wherein the controller sets the second voltage to reduce a difference in potential between the first voltage and the second voltage, the first voltage being written to the two or more pixels of the pixel row.

3. The display apparatus according to claim 1, wherein the controller sets the second voltage identical among the pixels, based on the first voltage written to the two or more pixels.

4. The display apparatus according to claim 1, wherein the controller maintains an on-state of the counter transistor during a period from an end of a write period for retaining the first voltage in the capacitance element to a start of an initialization period for initializing the drive transistor in each of the pixels.

5. The display apparatus according to claim 3, wherein the controller maintains an on-state of the counter transistor during a period from an end of a write period for retaining the first voltage in the capacitance element to a start of an initialization period for initializing the drive transistor in each of the pixels.

6. A display apparatus, comprising:

pixels two-dimensionally arranged, wherein each of the pixels includes:

a light-emitting element;

a capacitance element which retains a first voltage fed through a signal line;

a drive transistor which feeds a current according to the first voltage to the light-emitting element;

a first write transistor which includes a source electrode and a drain electrode and is connected between the signal line and a gate electrode of the drive transistor, one of the source electrode and the drain electrode being connected to the signal line;

a second write transistor connected between (i) an other of the source electrode and the drain electrode of the first write transistor and (ii) the gate electrode of the drive transistor; and a counter transistor including a source electrode and a drain electrode, one of the source electrode and the drain electrode being connected between (iii) the other of the source electrode and the drain electrode of the first write transistor and (iv) one of a source electrode and a drain electrode of the second write transistor, an other of the source electrode and the drain electrode of the counter transistor being connected to a voltage line which feeds a second voltage, the voltage line is disposed in each of pixel rows, the display apparatus further comprises a controller which sets, for each pixel row of the pixel rows, the second voltage of the pixel row, based on the first voltage written to two or more pixels in the pixel row, and the controller sets the second voltage based on the first voltage written to a first pixel which performs black display when among the two or more pixels in the pixel row, a proportion of the two or more pixels which perform the black display is higher than or equal to a first proportion, and sets the second voltage based on the first voltage written to a second pixel which performs white display when among the two or more pixels in the pixel row, a proportion of the two or more pixels which perform the white display is higher than or equal to a second proportion.

* * * * *